US009289988B2

(12) United States Patent
Ozaki et al.

(10) Patent No.: US 9,289,988 B2
(45) Date of Patent: Mar. 22, 2016

(54) LIQUID EJECTION HEAD

(71) Applicant: CANON KABUSHIKI KAISHA, Tokyo (JP)

(72) Inventors: Hiroyuki Ozaki, Yokohama (JP); Mitsutoshi Hasegawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/224,239

(22) Filed: Mar. 25, 2014

(65) Prior Publication Data

US 2014/0292934 A1 Oct. 2, 2014

(30) Foreign Application Priority Data

Mar. 29, 2013 (JP) ..... 2013-071973

(51) Int. Cl.
*B41J 2/14* (2006.01)

(52) U.S. Cl.
CPC ..... *B41J 2/14201* (2013.01)

(58) Field of Classification Search
USPC ..... 347/47
See application file for complete search history.

(56) References Cited

U.S. PATENT DOCUMENTS

| | | | | |
|---|---|---|---|---|
| 8,714,705 | B2 | 5/2014 | Hasegawa | |
| 2011/0297146 | A1* | 12/2011 | Tanaka et al. | 128/200.14 |
| 2011/0303222 | A1* | 12/2011 | Tsuchiya et al. | 128/203.12 |
| 2013/0162716 | A1* | 6/2013 | Hasegawa | 347/40 |

FOREIGN PATENT DOCUMENTS

| | | | |
|---|---|---|---|
| JP | 06-246910 | A | 9/1994 |
| JP | 08-187842 | A | 7/1996 |
| JP | 2006-181819 | A | 7/2006 |

* cited by examiner

*Primary Examiner* — Manish S Shah
*Assistant Examiner* — Renee I Wilson
(74) *Attorney, Agent, or Firm* — Fitzpatrick, Cella, Harper & Scinto

(57) ABSTRACT

The invention provides a liquid ejection head including a substrate provided with an energy-generating element for generating energy utilized for ejecting a liquid; and a nozzle plate provided with an ejection orifice from which the liquid is ejected as a droplet and an opening from which a static-removable gas for electrically neutralizing the droplet is jetted, the nozzle plate being joined to the substrate.

13 Claims, 9 Drawing Sheets

LIQUID EJECTION HEAD

BACKGROUND OF THE INVENTION

1. Field of the Invention

The present invention relates to a liquid ejection head for ejecting a liquid.

2. Description of the Related Art

An ink jet system has been devised as a printing method and utilized in a wide variety of fields in recent years. In an ink jet apparatus industrially used in particular, the spread of an ink droplet formed, the film thickness uniformity, and satellites and mists generated from the ink droplet are important factors to determine print quality. These factors are affected by electrification of an ink droplet, which is caused in the course of from ejection of the ink droplet to impact of the ink droplet. Therefore, it is required to neutralize or remove the electrification of the ink droplet.

Japanese Patent Application Laid-Open No. H06-246910 discloses a printing apparatus and a printing method by which a laminatedly electrified layer on a printing object can be removed in advance for improving the quality of printing. The printing apparatus makes printing on the printing object while relatively moving a printing head with respect to the printing object. In the printing head, a static electricity removing unit is provided on a forward side in the relatively moving direction of the printing head with respect to the printing object. Accordingly, static electricity of the laminatedly electrified layer generated on a printing surface of the printing object is removed just before conducting printing on the printing object by the printing head. As the static electricity removing unit, an ionic-wind generator for generating ionic wind for electrically neutralizing electrification of the printing object is mentioned.

Japanese Patent Application Laid-Open No. H08-187842 discloses an ink jet recording apparatus capable of stabilizing a flying orbit of an ink particle to achieve stable print quality. The ink jet recording apparatus is provided with an ink micronizing unit for micronizing an ink, a charge applying unit for applying a charge to the ink particle and an electric field deflecting unit for deflecting and controlling the ink particle to which the charge has been applied by an electric field. The ink jet recording apparatus can conduct printing by causing the ink particle to be flown on a predetermined orbit owing to this construction and to reach a predetermined position of a printing object. The ink jet recording apparatus is further provided with a unit for removing a charge electrified on the printing object or a peripheral member of the printing object. As the charge removing unit, the same ionic-wind generator as in Japanese Patent Application Laid-Open No. H06-246910 is mentioned.

Japanese Patent Application Laid-Open No. 2006-181819 discloses an ink jet printer provided with a pressure chamber which sends out an ink for ejecting the ink from an ink nozzle and an air channel which adjoins the pressure chamber and introduces air controlled to a predetermined temperature into the pressure chamber to control the temperature of the ink in the pressure chamber.

According to the constructions disclosed in Japanese Patent Application Laid-Open No. H06-246910 and Japanese Patent Application Laid-Open No. H08-187842, however, it is difficult that the ionic wind generated by the ionic-wind generator is caused to enter into a narrow space between a nozzle plate in which an ejection orifice is formed and the printing object. Accordingly, it is difficult to efficiently conduct static removal of a droplet ejected from the ejection orifice on the nozzle plate. In addition, two-dimensional arrangement of ejection orifices is effective for realizing the formation of a high-quality and high-density image on the printing object. However, it is more difficult to efficiently conduct static removal of ink droplets ejected from two-dimensionally arranged ejection orifices.

The ink jet printer disclosed in Japanese Patent Application Laid-Open No. 2006-181819 is so constructed that the air channel is provided at a part adjoining an ink channel. The air is introduced for controlling the temperature of the ink in the ink channel, so that there is no effect to remove electrification of an ink droplet, which is caused in the course of from ejection of the ink droplet to impact of the ink droplet.

SUMMARY OF THE INVENTION

In order to solve the above problems, the present invention provides a liquid ejection head comprising: a substrate provided with an energy-generating element for generating energy utilized for ejecting a liquid; and a nozzle plate provided with an ejection orifice from which the liquid is ejected as a droplet and an opening from which a static-removable gas for electrically neutralizing the droplet is jetted, the nozzle plate being joined to the substrate.

In order to solve the above problems, the present invention provides a liquid ejection head comprising: a first ejection orifice and a second ejection orifice from which a liquid is ejected; and an opening formed between the first and second ejection orifices from which a static-removable gas for relaxing electrification of a droplet ejected from at least one of the first and second ejection orifices is jetted, the opening being formed between the first and second ejection orifices.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings. In the following embodiments, a liquid ejection head provided with a piezoelectric block as an energy-generating element generating energy utilized for ejecting a liquid is described. However, the present invention is not limited thereto and is also applicable to a liquid ejection head of such a type that a heat-generating element (heater) is provided as an energy-generating element for ejection.

Figure 1A:
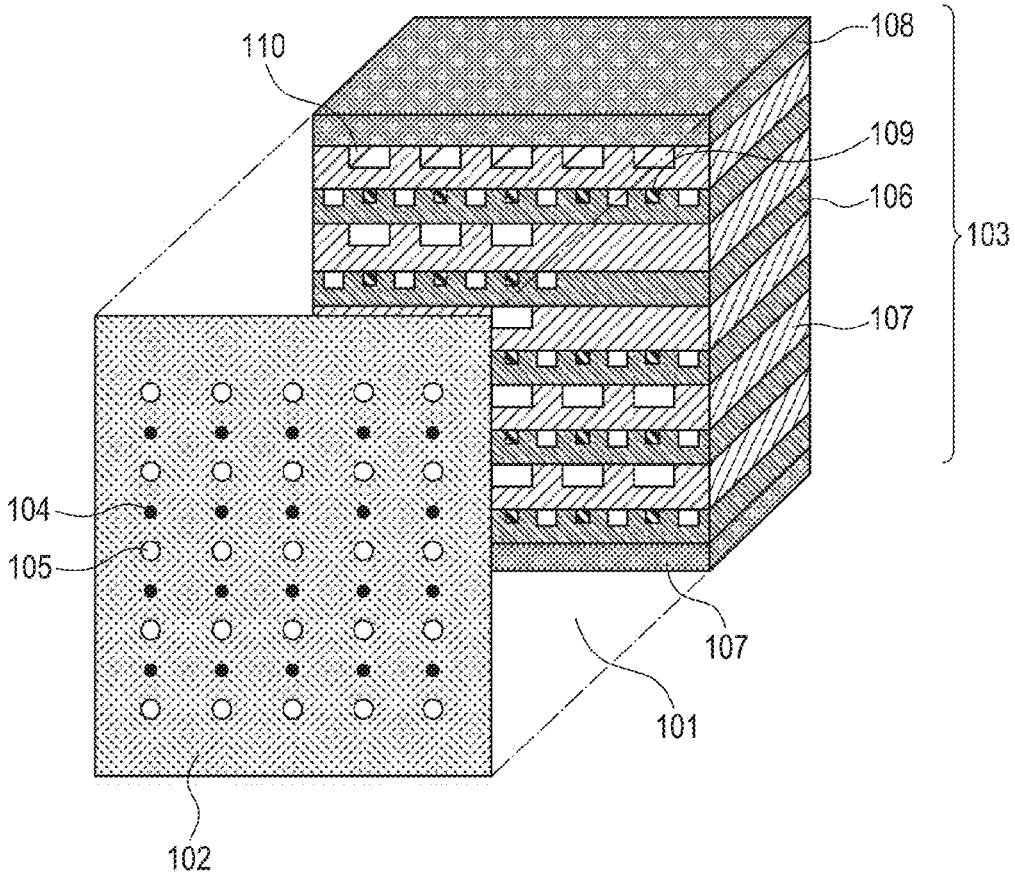
FIG. 1A is a schematic view illustrating the structure of a liquid ejection head according to a first embodiment of the present invention.
Figure 1B:
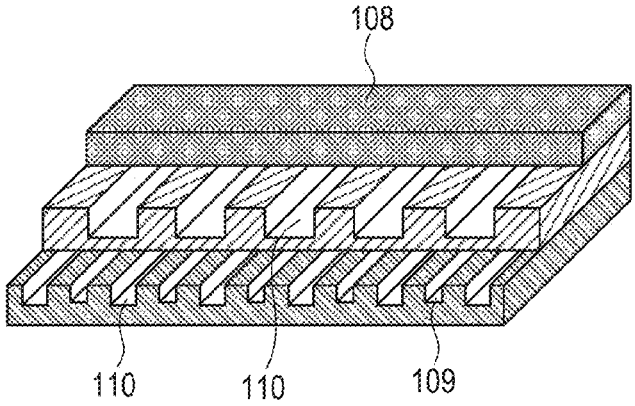
FIG. 1B is an expanded view illustrating the periphery of a pressure chamber in FIG. 1A.

FIG. 1A is a schematic view illustrating the structure of a liquid ejection head 101 according to a first embodiment of the present invention, and FIG. 1B is an expanded view thereof. The liquid ejection head 101 according to this embodiment has a nozzle plate 102, a piezoelectric block 103 and an ink pool plate (not illustrated). The nozzle plate 102 is attached to a front surface of the piezoelectric block 103. Incidentally, the nozzle plate 102 is illustrated separately from the piezoelectric block 103 in FIG. 1A for easy understanding of the structure of the piezoelectric block 103. A plurality of ejection orifices 104 and a plurality of openings 105 each formed of a circular piercing hole are formed in the nozzle plate 102, and these ejection orifices 104 and openings 105 are two-dimensionally arranged at predetermined intervals. The ink pool plate (not illustrated) is attached to a back surface of the piezoelectric block 103.

Figure 2:
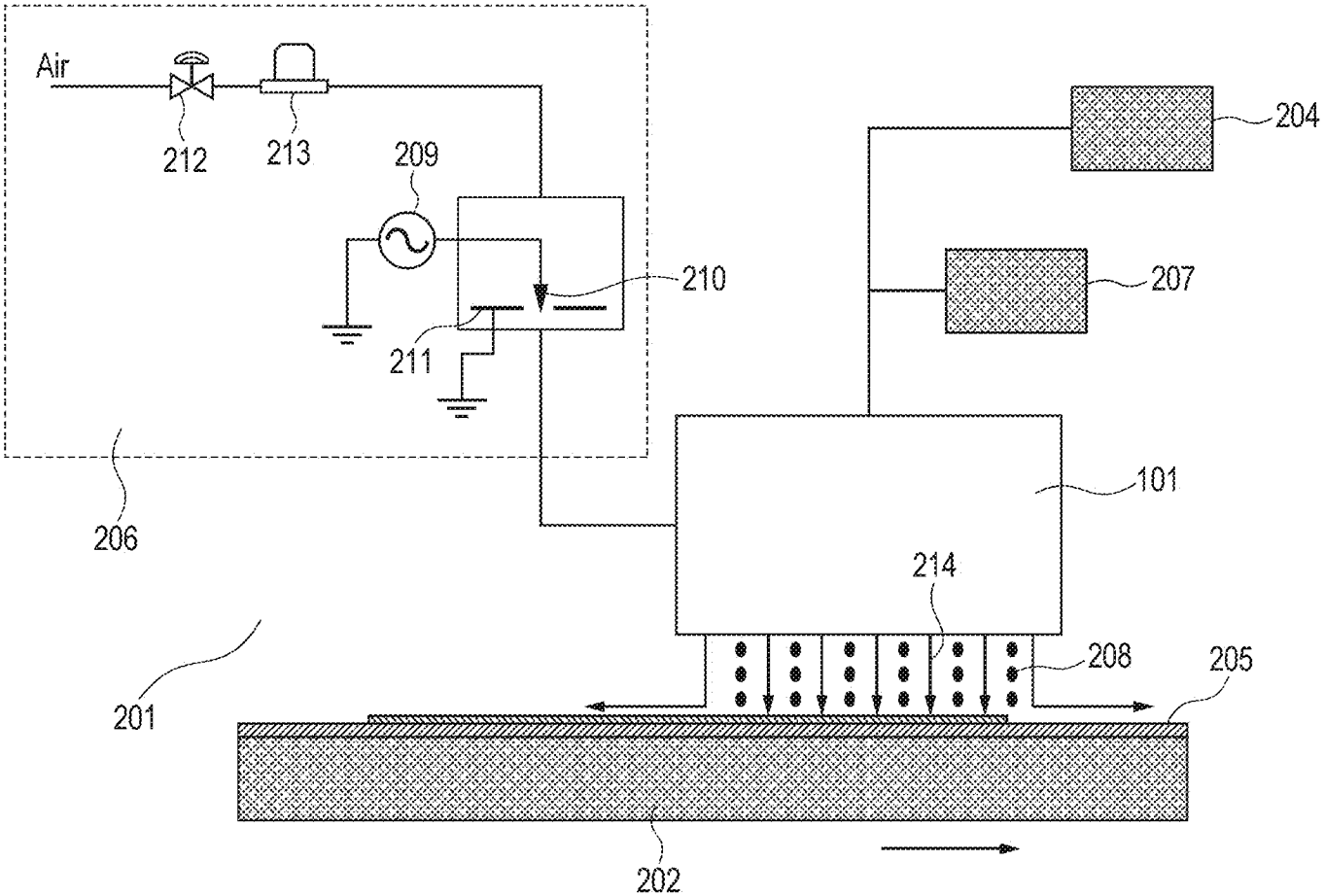
FIG. 2 is an entire schematic view of a liquid ejection apparatus according to the first embodiment of the present invention.

FIG. 2 is a principal block diagram of a liquid ejection apparatus 201. The apparatus body has a stage 202, the liquid ejection head 101, an ink supply device 204, a printing object (substrate) 205, an ionic-wind-generating device 206 and a pressure-controlling device 207. The printing object (substrate) 205 is mounted on the stage 202 by an adsorbing unit (not illustrated), and an ink droplet 208 can be caused to impact on a desired position by moving the stage 202. As the ionic-wind-generating device 206 for generating a static-removable gas 214 capable of electrically neutralizing electrification of the ink droplet, a corona discharge system is used. According to this system, a high voltage is applied to a discharge core 210 from a high-voltage power source 209 to generate ion by interelectrode discharge caused between the core 210 and an adjoining earth electrode 211. In this embodiment, a direct current system is applied. However, the system may be either the direct current system or an alternating current system. In addition, clean air is introduced through a gas pressure controller 212 and a flow rate controller 213, whereby the generated static-removable gas 214 can be introduced into between the nozzle plate 102 in which the ejection orifices 104 are formed and the printing object 205.

The piezoelectric block 103 is a laminate obtained by alternately laminating a first piezoelectric plate 106 and a second piezoelectric plate 107 plural times and laminating a third piezoelectric plate 108 on the top and the bottom. The first piezoelectric plate 106 is provided with a plurality of pressure chambers 109 communicating with the respective ejection orifices 104 for storing a liquid and a plurality of gas channels 110 communicating with the respective openings 105 for causing the static-removable gas 214 to flow. In addition, a plurality of gas channels 110 are also provided in the second piezoelectric plate 107 so as to arrange the gas channels 110 around the pressure chamber 109. An electrode is formed on surfaces on both sides of a partition wall partitioning between the pressure chamber 109 and the gas channel 110, and a voltage is applied between the pressure chamber 109 and the gas channel 110, whereby the partition wall is expansibly deformed to eject an ink droplet from the ejection orifice 104. On the other hand, the static-removable gas 214 formed by the ionic-wind-generating device 206 is jetted from the opening 105 through the gas channel 110. Further, an insulating layer is formed on inner walls of the pressure chambers 109 and the gas channels 110 and peripheries of the openings 105 of the nozzle plate 102 after the formation of the electrode so as not to lower the static charge removability, and it is desirable to insulate all surfaces coming into contact with the static-removable gas 214.

A process for ejecting an ink droplet on the printing object 205 while actually jetting the static-removable gas 214 will now be described.

Figure 3:
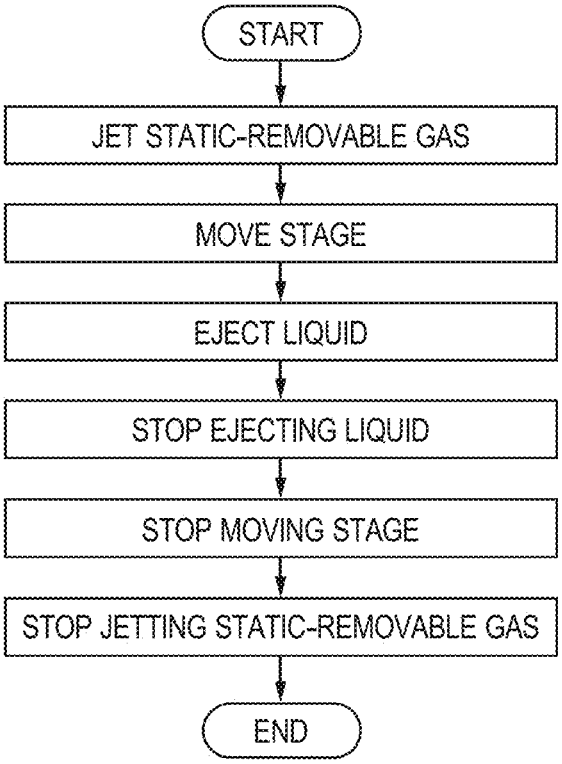
FIG. 3 is a flow diagram illustrating a process for ejecting an ink droplet according to the first embodiment of the present invention.

In this embodiment, a liquid is ejected according to the flow diagram illustrated in FIG. 3. First of all, the static-removable gas 214 formed by the ionic-wind-generating device 206 is jetted from the opening 105 provided in the nozzle plate 102. Thereafter, an ink droplet 208 is ejected from the ejection orifice 104 of the liquid ejection head 101 while moving the printing object 205 toward a predetermined position by operating the stage 202. After the liquid ejection is completed, the stage 202 is stopped at a desired position, and the jetting of the static-removable gas 214 is stopped. However, the present invention is not limited to the flow diagram illustrated in FIG. 3, and the same effect is achieved even when the static-removable gas is jetted at the same time of the moving of the stage.

The static-removable gas is jetted from the opening 105 provided on the face of the ejection orifice 104 in this manner, whereby static removal of the ink droplet 208 flying for a narrow distance (for example, 500 μm or less) between the nozzle plate 102 and the printing object 205 can be efficiently conducted. When the static-removable gas 214 is jetted from the vicinity of the ejection orifice 104, an adverse influence on ink droplet impact accuracy is generally apprehended by influence of air flow thereof. However, the distance between the nozzle plate 102 and the printing object 205 is made close to hasten (for example, 100 times) the ejection speed of the flying ink droplet 208 with respect to the flow speed of the static-removable gas 214, whereby the influence on the flying ink droplet 208 can be lessened.

Figure 4:
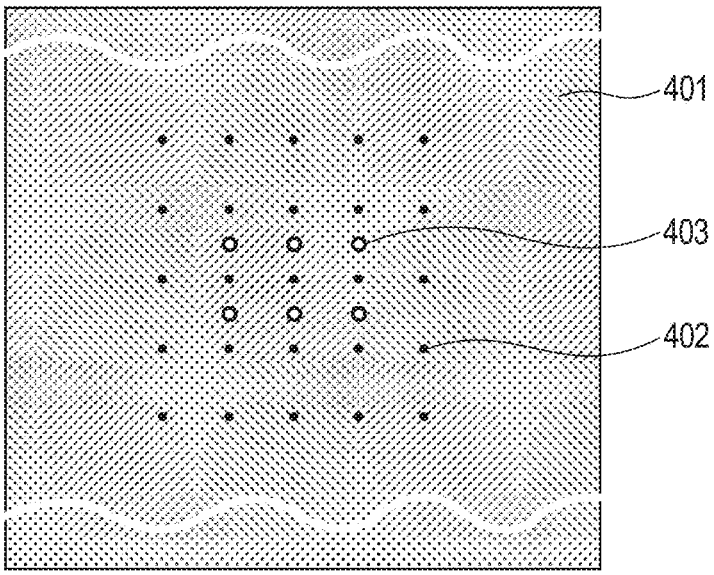
FIG. 4 is a schematic view illustrating the structure of a liquid ejection head according to a second embodiment of the present invention.

FIG. 4 is a schematic view illustrating the structure of a nozzle plate 401 of a liquid ejection head according to a second embodiment of the present invention. Since the fundamental structure thereof is the same as in the first embodiment, descriptions of the same portions are omitted. As illustrated in FIG. 4, an opening 403 for jetting the static-removable gas is provided between arrays of ejection orifices 402. The static-removable gas is jetted from the opening 403 provided between the arrays of the ejection orifices 402 in this manner, whereby static removal of an ink droplet flying for a narrow distance between the nozzle plate 401 and a printing object (not illustrated) can be efficiently conducted.

Figure 5:
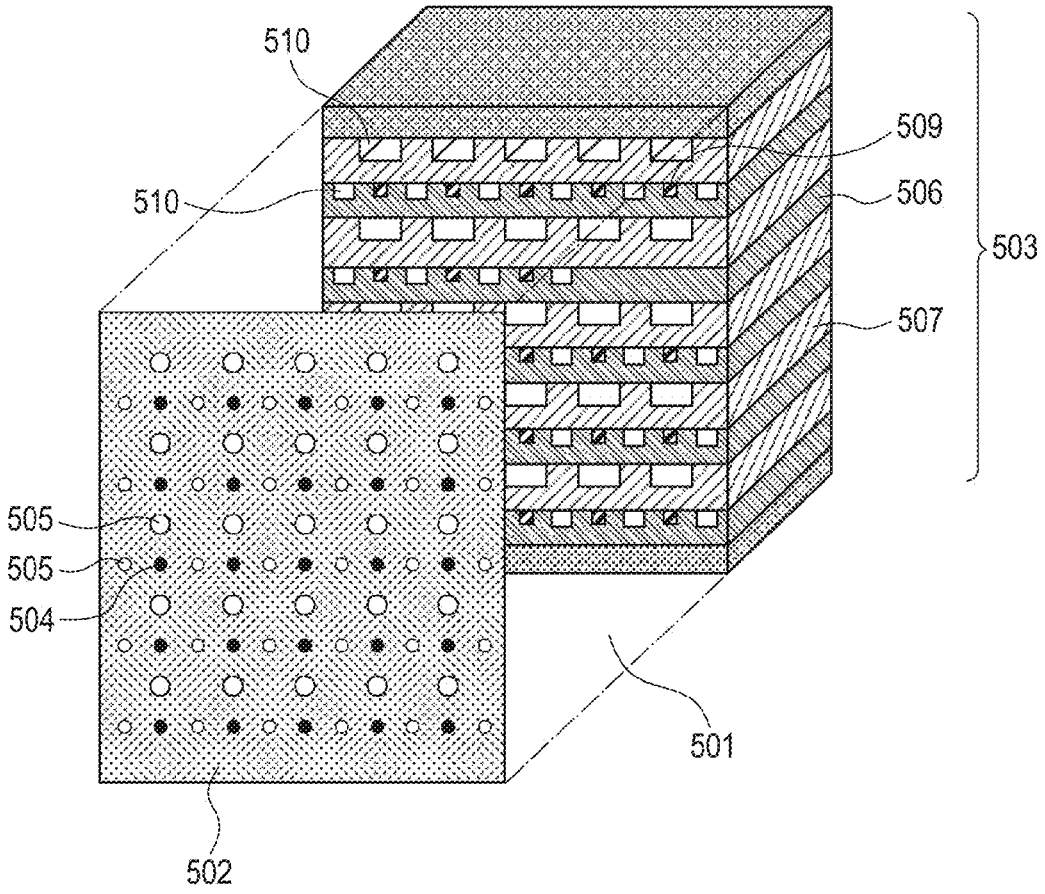
FIG. 5 is a schematic view illustrating the structure of a liquid ejection head according to a third embodiment of the present invention.

FIG. 5 is a schematic view illustrating the structure of a liquid ejection head 501 according to the third embodiment of the present invention. Since the fundamental structure thereof is the same as in the first embodiment, descriptions of the same portions are omitted. In the third embodiment, openings 505 for jetting a static-removable gas are arranged alternately with ejection orifices 504 in both directions of a predetermined direction (X-axis direction) on the face of a nozzle plate 502 and a direction (Y-axis direction) intersecting the predetermined direction as illustrated in FIG. 5. The static-removable gas is jetted from the openings 505 arranged alternately with the ejection orifices 504 in this manner through gas channels 510 provided in a first piezoelectric plate 506 and a second piezoelectric plate 507, whereby static removal of an ink droplet can be efficiently conducted even when the ink droplet ejected from the ejection orifice 504 through a pressure chamber 509 flies for a narrow distance between the nozzle plate 502 and a printing object (not illustrated).

Figure 6:
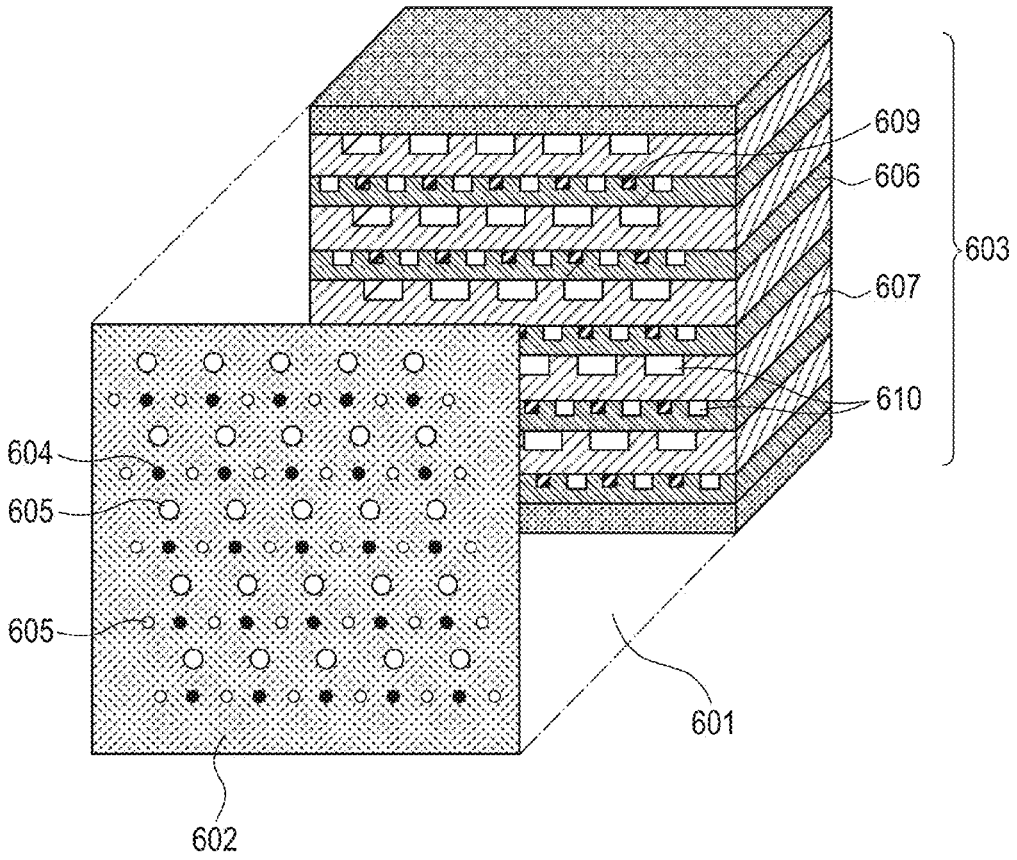
FIG. 6 is a schematic view illustrating the structure of a liquid ejection head according to a fourth embodiment of the present invention.

FIG. 6 is a schematic view illustrating the structure of a liquid ejection head 601 according to a fourth embodiment of the present invention. Although a fundamental structure thereof is the same as in the third embodiment, pressure chambers 609 and ejection orifices 604 are shifted in the X-axis direction as going in the Y-axis direction. Accordingly, gas channels 610 and openings 605 are also so arranged as to be shifted in the X-axis direction as illustrated in FIG. 6. Even in the liquid ejection head in which the pressure chambers 609 and the ejection orifices 604 are shifted in the X-axis direction in this manner, the static-removable gas is jetted from the opening 605 provided in a nozzle plate 602, whereby static removal of an ink droplet can be efficiently conducted even when the ink droplet ejected from the ejection orifice 604 through the pressure chamber 609 flies for a narrow distance between the nozzle plate 602 and a printing object (not illustrated).

Figure 7:
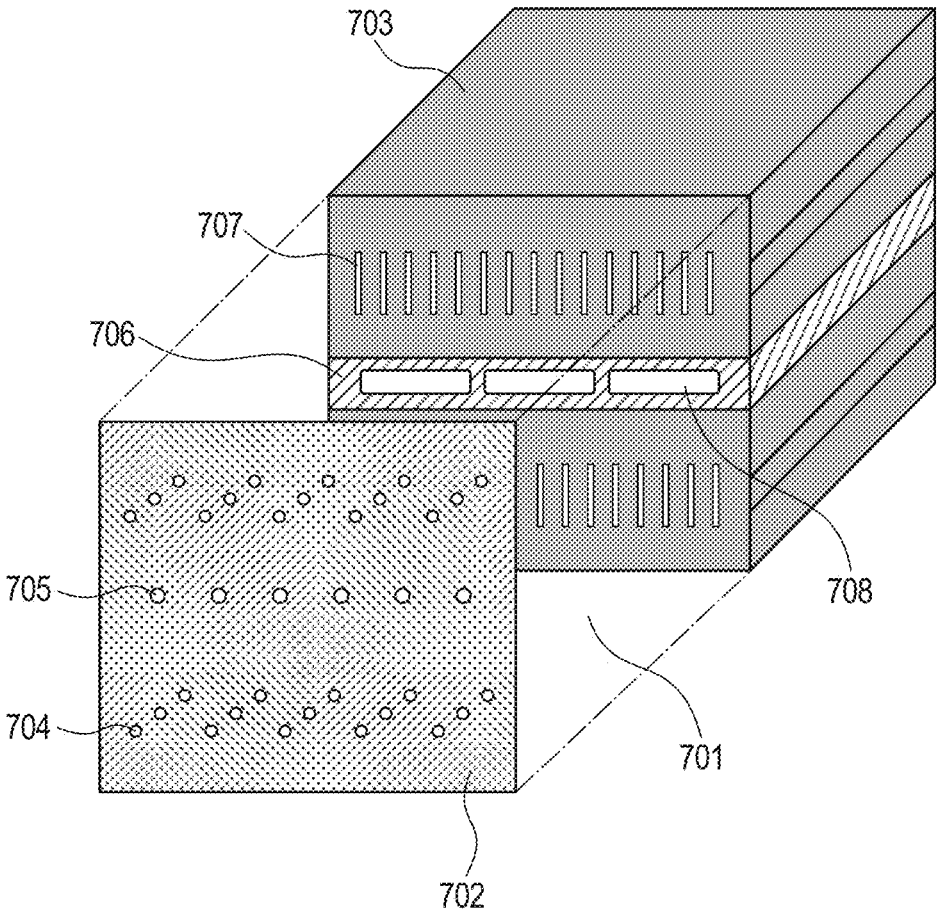
FIG. 7 is a schematic view illustrating the structure of a shear mode head according to a fifth embodiment of the present invention.

FIG. 7 is a schematic view illustrating the structure of a liquid ejection head 701 according to a fifth embodiment of the present invention. In this embodiment, the liquid ejection head 701 is of a head system generally called a shear mode type. A voltage is applied to an inner wall of a pressure chamber 707 formed in a piezoelectric plate 703 as illustrated in FIG. 7 to deform the inner wall in a direction for increasing an internal pressure in the pressure chamber 707, thereby ejecting an ink droplet from the pressure chamber 707 and an ejection orifice 704. In addition, an opening 705 for jetting the static-removable gas is provided between arrays of the ejection orifices 704 as illustrated in FIG. 7. The static-removable gas is jetted from the opening 705 through a gas channel 708 provided in a gas channel plate 706. The static-removable gas is jetted from the opening 705 provided between the arrays of the ejection orifices 704, whereby static removal of an ink droplet flying for a narrow distance between a nozzle plate 702 in which the ejection orifices are formed and a printing object (not illustrated) can be efficiently conducted. That is, even when the present invention is applied to the head system of the shear mode, not limited to a gourd type head, static removal of the flying ink droplet can be efficiently conducted.

Figure 8:
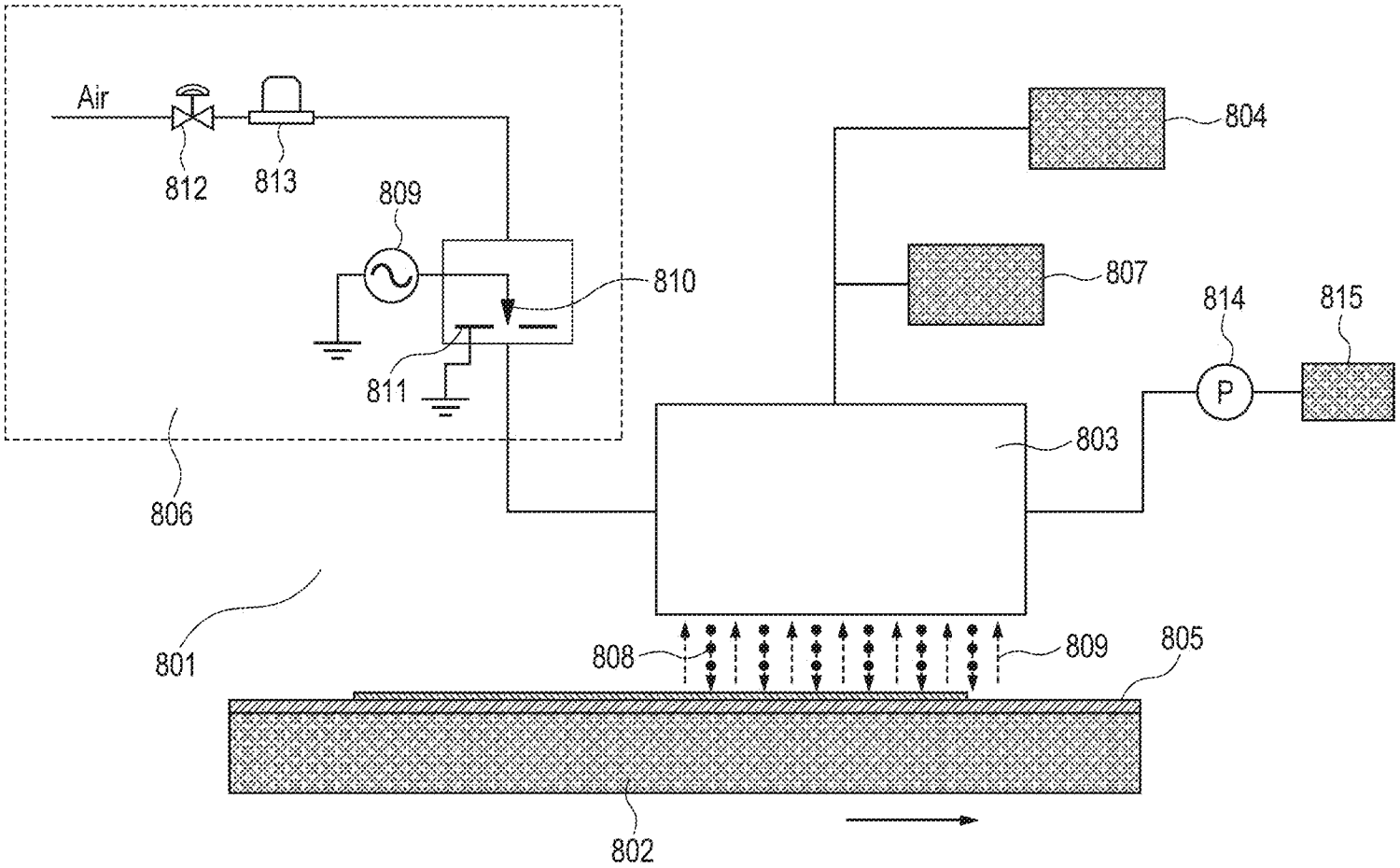
FIG. 8 is an entire schematic view of a liquid ejection apparatus according to a sixth embodiment of the present invention.
Figure 9A:
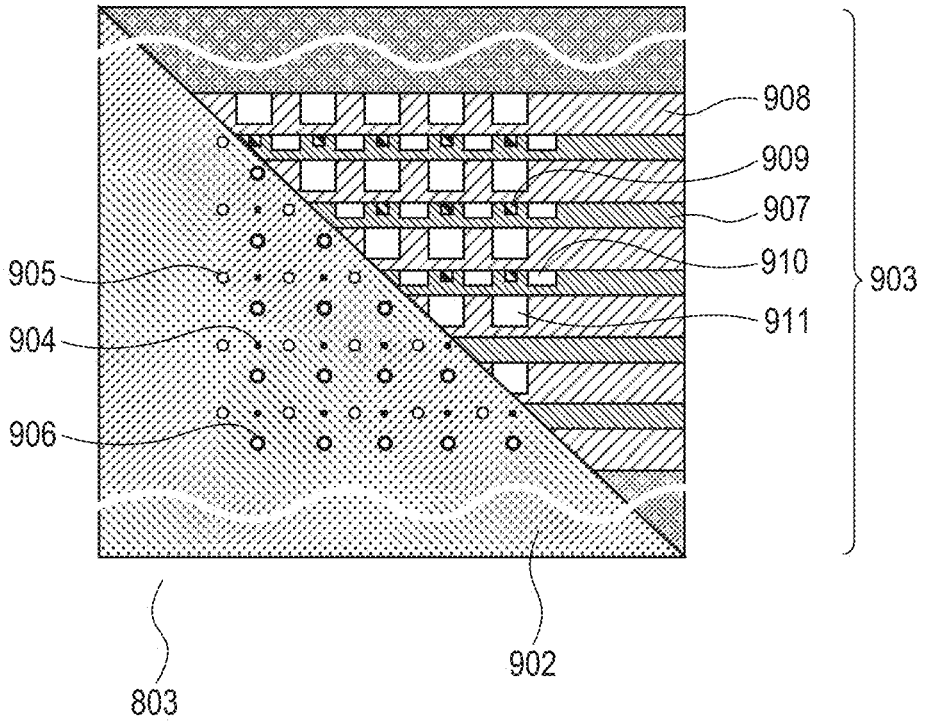
FIG. 9A is a schematic view illustrating the structure of a liquid ejection head according to the sixth embodiment of the present invention.
Figure 9B:
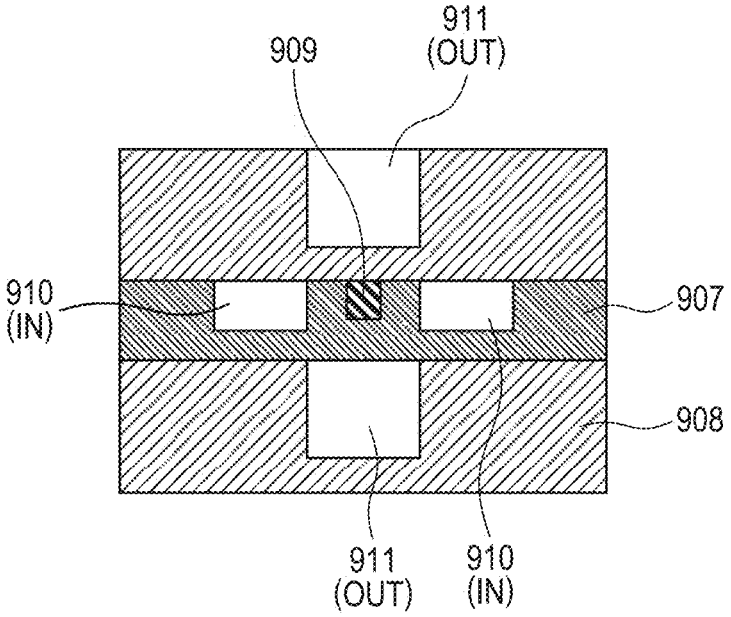
FIG. 9B is an expanded view illustrating the periphery of a pressure chamber in FIG. 9A.

FIG. 8 is a principal block diagram of an ink jet apparatus 801 according to a sixth embodiment of the present invention. FIG. 9A is a schematic view illustrating the structure of a liquid ejection head 803 according to this embodiment, and FIG. 9B is an expanded view illustrating a pressure chamber 909, a gas channel (IN) 910 and a gas channel (OUT) 911. Since the fundamental structure thereof is the same as in the first embodiment, descriptions of the same portions are omitted.

The ink jet apparatus 801 has a stage 802, the liquid ejection head 803, an ink supply device 804, a printing object (substrate) 805, an ionic-wind-generating device 806 and a pressure-controlling device 807. The printing object (substrate) 805 is mounted on the stage 802 by an adsorbing unit (not illustrated), and an ink droplet 808 can impact on a desired position by moving the stage 802. As the ionic-wind-generating device 806, a corona discharge system is used. According to this system, a high voltage is applied to a discharge core 810 from a high-voltage power source 809 to generate an ion by interelectrode discharge caused between the core and an adjoining earth electrode 811. In this embodiment, a direct current system is applied. However, the system may be either the direct current system or an alternating current system. The system is desirably selected in accordance with respective characteristics or features. In addition, the apparatus is provided with a gas pressure controller 812 and a flow rate controller 813 for introducing clean air into the ionic-wind-generating device 806, and a pump 814 and an exhaust gas treatment device 815 for exhausting the static-removable gas introduced.

The gas channel (IN) 910 formed in a first piezoelectric plate 907 as illustrated in FIG. 9A and FIG. 9B is used as a flow path for jetting the static-removable gas 809. The static-removable gas 809 supplied from the ionic-wind-generating device 806 is jetted from an opening (IN) 905 in a nozzle plate 902 through the gas channel (IN) 910.

On the other hand, the gas channel (OUT) 911 formed in a second piezoelectric plate 908 is used as a flow path for exhausting the static-removable gas 809 from an opening (OUT) 906, and the static-removable gas is exhausted in the exhaust gas treatment device 815 through the pump 814. The openings 905 and 906 are utilized for both jetting and exhaustion in this manner, whereby a narrow space between the nozzle plate 902 and the printing object 805 can be filled with the static-removable gas 809 to more efficiently conduct static removal of the flying ink droplet 808.

Figure 10:
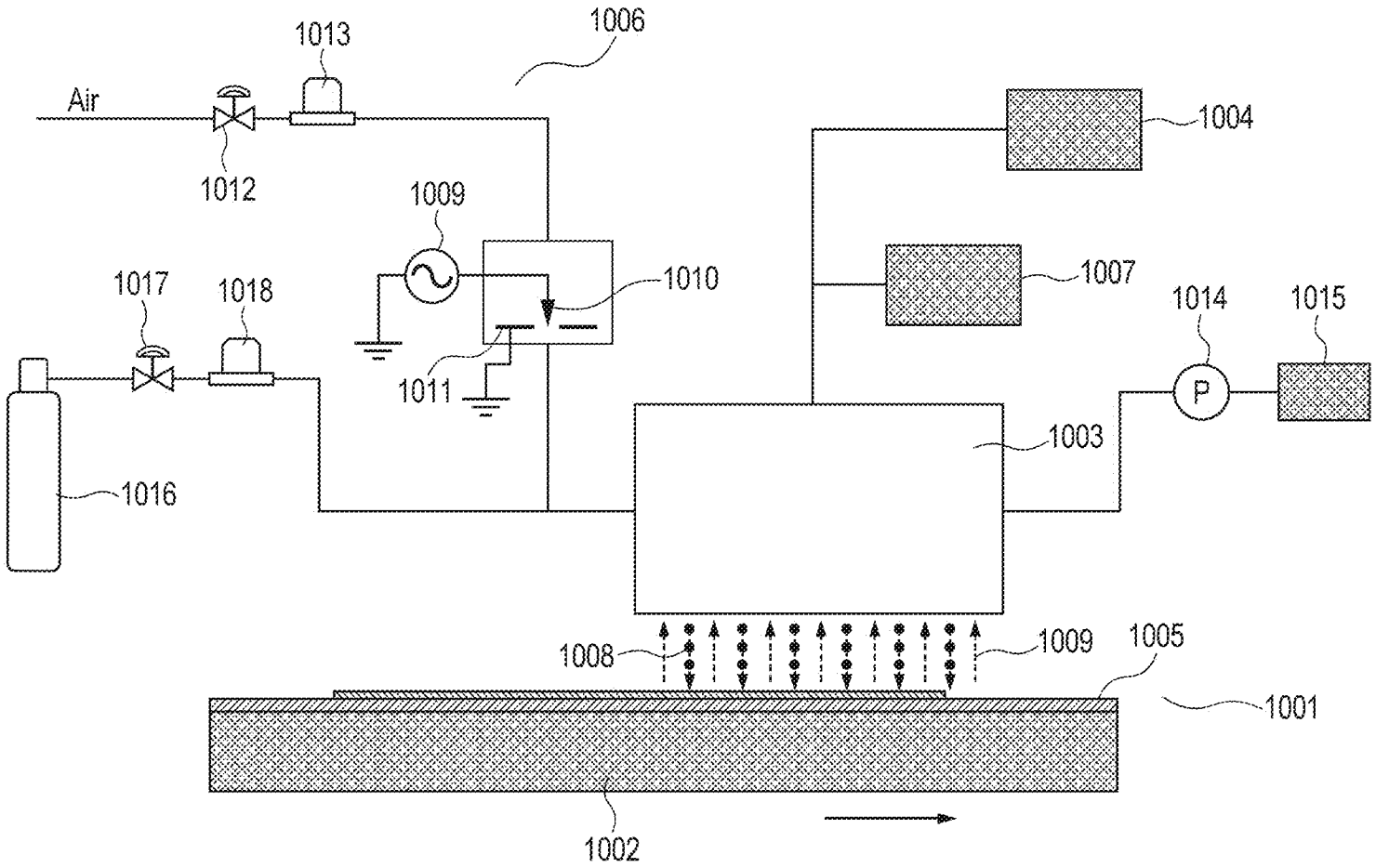
FIG. 10 is an entire schematic view of a liquid ejection apparatus according to a seventh embodiment of the present invention.

FIG. 10 is a principal block diagram of an ink jet apparatus 1001 according to a seventh embodiment of the present invention. The fundamental structure thereof is the same as in the sixth embodiment. In the seventh embodiment, however, the static-removable gas is mixed with a gas capable of inhibiting oxidation of an ejected droplet in addition to the sixth embodiment.

Detailed description will now be given. The ink jet apparatus 1001 has a stage 1002, a liquid ejection head 1003, an ink supply device 1004, a printing object (substrate) 1005, an ionic-wind-generating device 1006 and a pressure-controlling device 1007. The printing object (substrate) 1005 is mounted on the stage 1002 by an adsorbing unit (not illustrated), and an ink droplet 1008 can impact on a desired position by moving the stage 1002. As the ionic-wind-generating device 1006, a corona discharge system is used. A high voltage is applied to a discharge core 1010 from a high-voltage power source 1009 to generate an ion by interelectrode discharge caused between the core and an adjoining earth electrode 1011. In addition, the apparatus is provided with a gas pressure controller 1012 and a flow rate controller 1013 for introducing clean air into the ionic-wind-generating device 1006, and a pump 1014 and an exhaust gas treatment device 1015 for exhausting the static-removable gas introduced.

The ink jet apparatus 1001 according to this embodiment is further provided with an oxidation-inhibiting gas cylinder 1016, a controller 1017 and a flow rate controller 1018 for introducing an oxidation-inhibiting gas, and the oxidation-inhibiting gas is mixed with the static-removable gas before entering the gas channel. In this embodiment, the oxidation-inhibiting gas is mixed after the ionic wind is generated. However, the present invention is not limited thereto, and the same effect is achieved even when the oxidation-inhibiting gas is mixed with clean air before the ionic wind is generated.

In addition, the oxidation-inhibiting gas may contain at least any one of helium, neon, argon, krypton and xenon.

The gas channel (IN) 910 formed in the first piezoelectric plate 907 as illustrated in FIG. 9A and FIG. 9B is used as a flow path for jetting a mixed gas 1009 of the static-removable gas and the oxidation-inhibiting gas, and the mixed gas is jetted from the opening (IN) 905 in the nozzle plate 902.

On the other hand, the gas channel (OUT) 911 formed in the second piezoelectric plate 908 is used as a flow path for exhausting the mixed gas 1009, and the mixed gas is exhausted in the exhaust gas treatment device 1015 through the pump 1014.

The oxidation-inhibiting gas is mixed with the static-removable gas in this manner, whereby a narrow space between the nozzle plate 902 and the printing object 805 can be filled with the mixed gas 1009. Accordingly, static removal of the flying ink droplet 1008 can be more efficiently conducted. In addition, oxidation of a wiring can be inhibited to inhibit a dispersion of wiring resistance.

It is effective to provide the opening for jetting the static-removable gas at the same face as the face in which the ejection orifice for ejecting a liquid is formed as described in the respective embodiments. An opening for jetting the static-removable gas is more favorably provided between ejection orifices. The electrification of a droplet flying in a narrow space between the ejection orifice and the printing object can be more effectively alleviated by such a construction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-071973, filed Mar. 29, 2013, which is hereby incorporated by reference herein in its entirety.

What is claimed is:

1. A liquid ejection head comprising:

a substrate provided with an energy-generating element for generating energy utilized for ejecting a liquid; and a nozzle plate provided with an ejection orifice from which the liquid is ejected as a droplet and an opening from which a static-removable gas for electrically neutralizing the droplet is jetted, the nozzle plate being joined to the substrate, wherein the static-removable gas is mixed with a gas capable of inhibiting oxidation of the droplet.

2. The liquid ejection head according to claim 1, wherein the ejection orifice and the opening are respectively provided in plural arrays, and the array of the opening is arranged between arrays of the ejection orifices.

3. The liquid ejection head according to claim 1, wherein the ejection orifice and the opening are alternately arranged in both directions of a predetermined direction and a direction intersecting the predetermined direction.

4. The liquid ejection head according to claim 1, further comprising a pressure chamber communicating with the ejection orifice for storing the liquid and a gas channel communicating with the opening for causing the static-removable gas to flow, and an electrode for expansively deforming a partition wall partitioning between the gas channel and the pressure chamber, the electrode being provided on surfaces on both sides of the partition wall.

5. The liquid ejection head according to claim 1, wherein the static-removable gas is exhausted through at least some of a plurality of the openings.

6. The liquid ejection head according to claim 1, wherein the static-removable gas is supplied from an ionic-wind-generating device.

7. The liquid ejection head according to claim 1, wherein the gas capable of inhibiting oxidation of the droplet contains at least any one of helium, neon, argon, krypton and xenon.

8. The liquid ejection head according to claim 4, wherein the gas capable of inhibiting oxidation of the droplet is mixed with the static-removable gas on an upstream side of the gas channel.

9. A liquid ejection head comprising:

a first ejection orifice and a second ejection orifice from which a liquid is ejected; and an opening from which a static-removable gas for relaxing electrification of a droplet ejected from at least one of the first and second ejection orifices is jetted, the opening being formed between the first and second ejection orifices, wherein the static-removable gas is mixed with a gas capable of inhibiting oxidation of the droplet.

10. The liquid ejection head according to claim 9, wherein the first and second ejection orifices and the opening are respectively provided in plural arrays, and the array of the opening is arranged between arrays of the ejection orifices.

11. The liquid ejection head according to claim 9, wherein the first and second ejection orifices and the opening are formed in a nozzle plate.

12. The liquid ejection head according to claim 9, wherein the gas capable of inhibiting oxidation of the droplet contains at least any one of helium, neon, argon, krypton and xenon.

13. The liquid ejection head according to claim 9, further comprising a gas channel communicating with the opening for causing the static-removable gas to flow, wherein the gas capable of inhibiting oxidation of the droplet is mixed with the static-removable gas on an upstream side of the gas channel.

* * * * *